United States Patent [19]

Okerblom

[11] 4,170,052

[45] Oct. 9, 1979

[54] HOLDING CLIP

[76] Inventor: Charles L. Okerblom, 20 Welch Rd., Warwick, R.I. 02889

[21] Appl. No.: 865,422

[22] Filed: Dec. 29, 1977

[51] Int. Cl.[2] ..... B42F 1/02; A44B 21/00

[52] U.S. Cl. ..... 24/67.9; 24/261 R

[58] Field of Search ..... 24/67.9, 261 R, 261 F, 24/261 C, 17 R; 248/302, 510

[56] References Cited

U.S. PATENT DOCUMENTS

| | | | |
|---|---|---|---|
| 395,473 | 1/1889 | Bartley | 24/67.9 |
| 400,138 | 3/1889 | Steinberger | 24/261 C |
| 649,338 | 5/1900 | McGill | 242/261 R |
| 714,388 | 11/1902 | Mussinan | 24/261 R |
| 779,522 | 1/1905 | Brosnan | 24/261 R |
| 808,687 | 1/1906 | Rosebrough | 24/261 R |
| 1,488,383 | 3/1924 | Crow | 24/261 R |
| 1,753,186 | 4/1930 | Baer | 24/261 R |
| 1,985,866 | 12/1934 | Lankenau | 24/261 R |
| 2,074,613 | 3/1937 | Laursen | 24/261 R |
| 2,642,638 | 6/1953 | Larrabee | 24/67.9 |
| 2,908,954 | 10/1959 | Chaun | 24/67.9 |
| 3,083,425 | 4/1963 | Minnerly | 24/67.9 |

FOREIGN PATENT DOCUMENTS

| | | | |
|---|---|---|---|
| 89250 | 6/1921 | Switzerland | 24/261 R |

*Primary Examiner*—Bernard A. Gelak

[57] ABSTRACT

This invention pertains to an improvement in holding clips or more specifically, to the type commonly referred to as "paper clips" and used to hold papers, documents, etc., together temporarily in an organized and nondestructive manner. The object of the device is to provide a wireform holding clip of low profile with substantially greater holding capacity and broad adjustment range so as to minimize "stack buildup" due to over extension, to accommodate substantial stack thickness, and to minimize the number of holding clip sizes required to serve a broad range of stack thicknesses.

8 Claims, 17 Drawing Figures

HOLDING CLIP

The device consists of counterbalancing cantilever beams connected at each end to torsion bar members which form the sides of front and rear frames, said side members connected at the bottom to form the bases of the front and rear frames, all members being part of one continuous wireform.

The front and rear frames act as jaws to hold the stacked material. The angularity of the cantilever beams, relative to the front and rear frames, changes with the thickness of the material being held. The "wind up" in the torsion bar members keeps the front and rear frames under "load" against the stacked material. Because the torsion bars are relatively long, and there are no points of stress concentration, the cantilever beams are capable of considerable angular rotation without excessive stress in any parts of the device. Since the torsion bars are "prestressed" with the front and rear frames in contact at the base, the device is capable of handling material from a few sheets thick, to much thicker stacks. The clip is so designed that the cantilever beams rotate in opposite directions, hence the torsional "wind up" in the torsion bars on opposite sides of each frame are also in opposite directions. This tends to balance the resulting forces and acts to hold the frames flat against the material stack.

Figure 1:
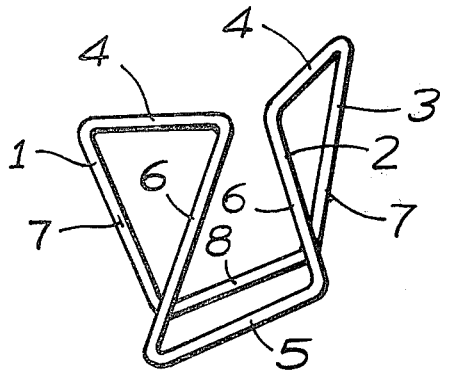

Other objects and advantages of the invention will in part be evident to those skilled in the art and in part pointed out hereinafter in the following descriptions taken in connection with the accompanying drawings wherein there is shown by way of illustration and not of limitation, some of the more obvious variations of functionally acceptable designs, FIG. 1 showing the preferred embodiment of the invention.

FIG. 1 shows the wireform holding clip (1) consisting of a front frame (2) and a rear frame (3) connected at the top with mirror image cantilever beams (4). The front frame (2) consists of a base member (5) connected to two torsion bar side members (6) which are angled upward and inward towards the center at the top. The front frame (2) is then connected to the two mirror image cantilever members (4) located in horizontal plane extending outward and slightly backwards to join the rear frame (3) outer ends. The rear frame (3) consists of torsion bar side members (7) projecting downward and angled inward slightly to join with a base member (8) of the rear frame (3) held against the front frame (2) near the base under tension. All parts of the device are made from one continuous piece of wire bent as required and joined at the center of the base member (5) of the front frame (2) by welding or other suitable means.

Figure 2:
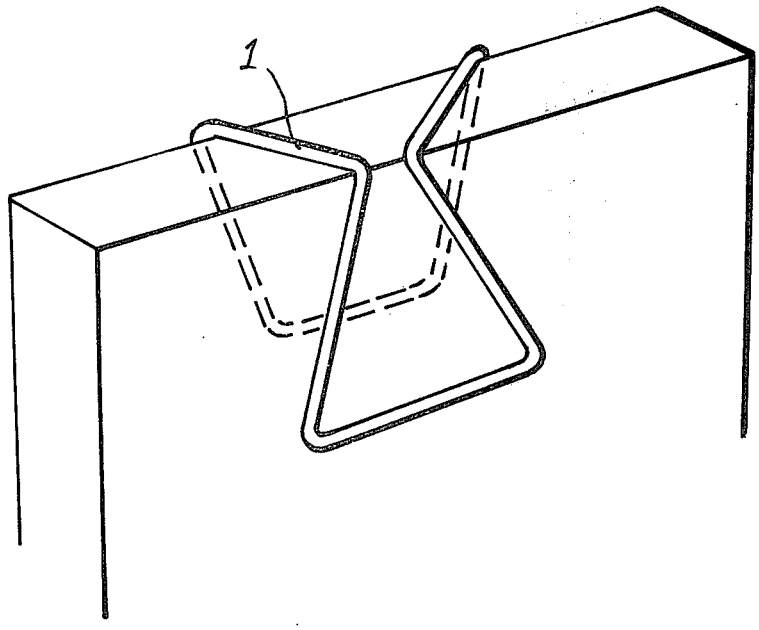

FIG. 2 shows the holding clip (1) graphically in position on a stack of papers on other materials.

Figure 3A:
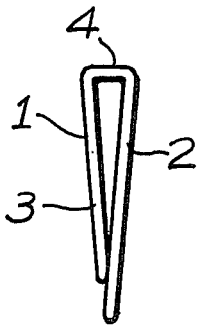

FIG. 3*a* is a side view of the holding clip (1) showing the angular relationship of the front frame (2) to the rear frame (3) due to the rearward canting of the centilever members (4).

Figure 3B:
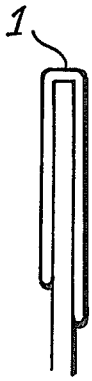
Figure 3C:
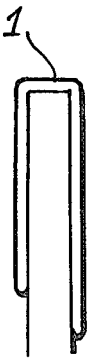
Figure 3D:
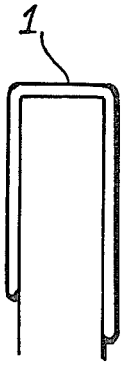

FIGS. 3*b*, 3*c* and 3*d* are side views showing the holding clip (1) as it automatically adjusts for broadly varying thickness of material.

Figure 4A:
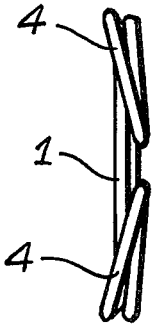

FIG. 4*a* is a top view of the holding clip (1) showing the angularity of the cantilever members (4).

Figure 4B:
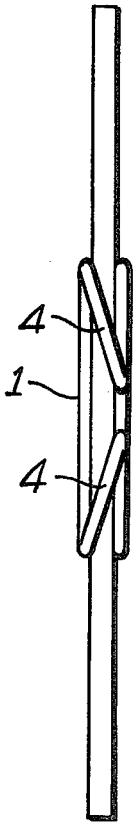
Figure 4C:
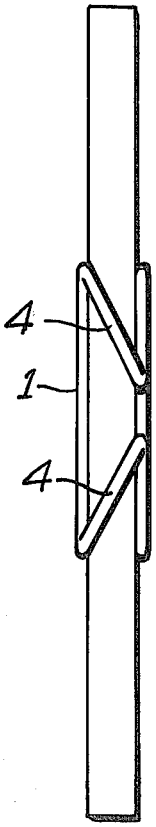
Figure 4D:
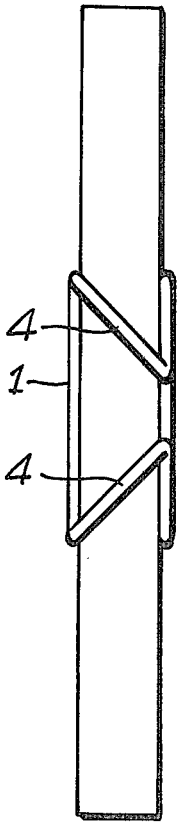
Figure 5:
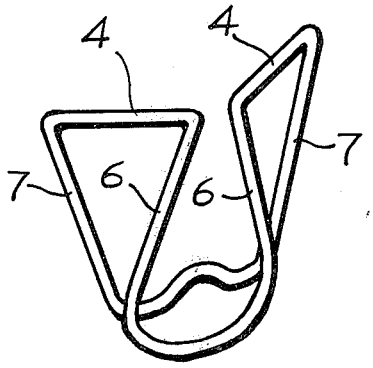
Figure 6:
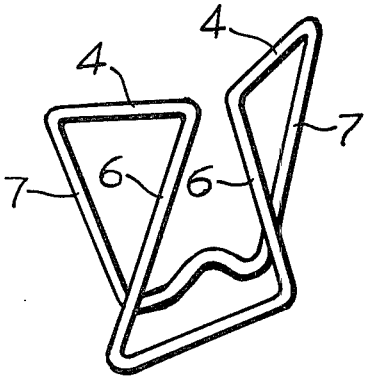
Figure 7:
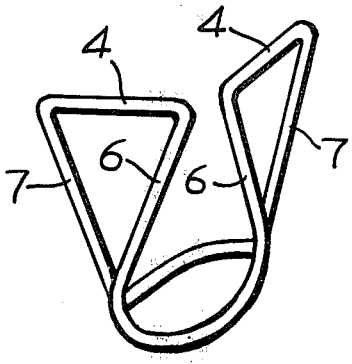
Figure 8:
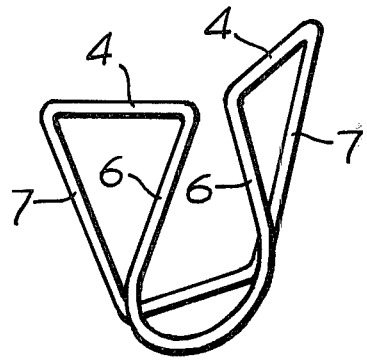
Figure 9:
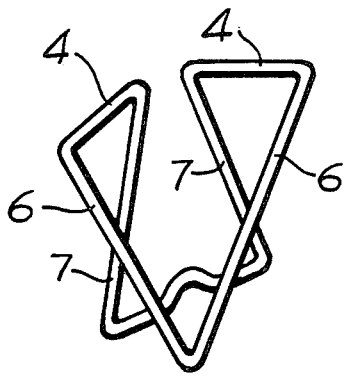
Figure 10:
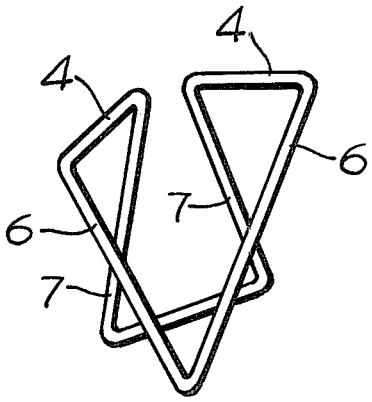
Figure 11:
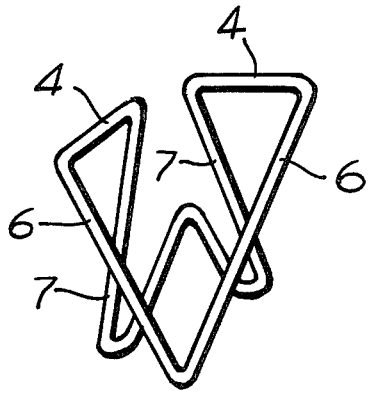

FIGS. 4*b*, 4*c* and 4*d* are top views showing changes in angularity of the cantilever members (4) as the holding clip (1) adjusts to broadly varying thicknesses of material.

FIGS. 5 through 11 are variations in design, all of which employ the principle of counterbalancing cantilever beams (4) and torsion bar side members (6), (7) of the front and rear frames.

I claim:

1. A wireform holding clip consisting of a front frame with horizontal base and sides angled inward to the center at the top and continuous with cantilever top members extending outward and slightly back from the front frame plane and continuous with side members of a rear frame, said side members angled inward and downward and continuous with a horizontal member forming the base of the rear frame.

2. A wireform holding clip consisting of a front frame with a horizontal base and sides angled inward to the center at the top and continuous with cantilever top members extending outward and slightly back from the front frame plane and continuous with side members of a rear frame, said side members angled inward and downward and continuous with a horizontal member forming the base of the rear frame, said rear rear frame base at a higher elevation than said front frame base.

3. A wireform holding clip consisting of a front frame with horizontal base and sides angled inward and upward to the center at the top and continuous with cantilever top members extending outward and slightly back from the front frame plane and continuous with side members of a rear frame, said side members angled inward and downward and continuous with a horizontal member forming the base of the rear frame, said rear frame base at a higher elevation than said front frame base and energized against the side members of the front frame.

4. A wireform holding clip consisting of a front frame with a horizontal base and sides angled inward and upward to the center at the top and continuous with cantilever top members extending outward and slightly back from the front frame plane and continuous with side members of a rear frame, said side members angled inward and downward and continuous with a horizontal member forming the base of the rear frame, said base of the front frame having a centrally located break where opposite ends of the wire meet.

5. A wireform holding clip consisting of a front frame with a horizontal base and sides angled inward and upward to the center at the top and continuous with cantilever top members extending outward and slightly back from the front frame plane and continuous with side members of a rear frame, said side members angled inward and downward and continuous with a horizontal member forming the base of the rear frame, said rear frame at a lower elevation than said front frame base.

6. A wireform holding clip consisting of a front frame with a horizontal base and sides angled inward and upward to the center at the top and continuous with cantilever top members extending outward and slightly back from the front frame plane and continuous with side members of a rear frame, said side members angled inward and downward and continuous with a rear frame base member which has a raised portion, centrally located.

7. A wireform holding clip consisting of a front frame with a curved base member extending downward and continuous with side members angled inward and upward to the center at the top and continuous with cantilever top members extending outward and slightly back from the front frame plane and continuous with side members of a rear frame, said side members angled inward and downward and continuous with a horizontal member forming the base of the rear frame, said rear frame base at a higher elevation than the curvature of the front frame base.

8. A wireform holding clip consisting of a front frame formed by two sides centrally joined at the base and angled outward and upward and continuous with horizontal cantilever top members angled inward and slightly back from the front frame plane to the center and continuous with side members of a rear frame, said side members angled outward and downward and continuous with a horizontal base member.

* * * * *